US011353262B2

(12) United States Patent
Hirose

(10) Patent No.: US 11,353,262 B2
(45) Date of Patent: Jun. 7, 2022

(54) NITROGEN PRODUCTION METHOD AND NITROGEN PRODUCTION APPARATUS

(71) Applicant: L'Air Liquide, Societe Anonyme pour l'Etude et l'Exploitation des Procedes Georges Claude, Paris (FR)

(72) Inventor: Kenji Hirose, Kobe (JP)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 518 days.

(21) Appl. No.: 16/359,150

(22) Filed: Mar. 20, 2019

(65) Prior Publication Data

US 2019/0293348 A1 Sep. 26, 2019

(30) Foreign Application Priority Data

Mar. 20, 2018 (JP) ..... JP2018-51957

(51) Int. Cl.
*F25J 1/00* (2006.01)
*F25J 3/00* (2006.01)
(Continued)

(52) U.S. Cl.
CPC ..... *F25J 3/066* (2013.01); *F25J 1/0012* (2013.01); *F25J 1/0032* (2013.01); *F25J 1/0055* (2013.01); *F25J 3/042* (2013.01); *F25J 3/044* (2013.01); *F25J 3/0429* (2013.01); *F25J 3/04048* (2013.01); *F25J 3/04175* (2013.01); *F25J 3/04284* (2013.01); *F25J 3/04333* (2013.01);
(Continued)

(58) Field of Classification Search
CPC .. F25J 1/00; F25J 1/0002; F25J 1/0012; F25J 1/0015; F25J 1/0032; F25J 1/0035; F25J 1/0037; F25J 1/0045; F25J 1/0075; F25J 2210/06; F25J 2215/42; F25J 2215/44; F25J 2240/02; F25J 2240/04; F25J 2240/10; F25J 2240/12; F25J 2240/20; F25J 2240/22; F25J 2240/40; F25J 2240/46; F25J 2240/48; F25J 2245/50; F25J 3/04; F25J 3/04284; F25J 3/0429; F25J 3/04296; F25J 3/4303; F25J 3/04309; F25J 3/04315; F25J 3/04321; F25J 3/04375; F25J 3/04387; F25J 3/04393; F25J 2270/40; F25J 2270/06
See application file for complete search history.

(56) References Cited

U.S. PATENT DOCUMENTS 4,595,405 A * 6/1986 Agrawal ..... F25J 3/04393 62/646
4,867,773 A * 9/1989 Thorogood ..... F25J 3/04284 62/652
(Continued)

FOREIGN PATENT DOCUMENTS

JP H11-316079 11/1999

*Primary Examiner* — Jianying C Atkisson
*Assistant Examiner* — Erik Mendoza-Wilkenfel
(74) *Attorney, Agent, or Firm* — Justin K. Murray

(57) ABSTRACT

A portion of feed air is expanded and cooled in front of a main heat exchanger, and is used as cold for precooling the remaining unexpanded feed air inside the main heat exchanger. A portion of the feed air precooled inside the main heat exchanger is removed to outside the main heat exchanger, expanded and cooled, and used as cold to cool the remaining unexpanded precooled feed air inside the main heat exchanger.

9 Claims, 6 Drawing Sheets

(51) Int. Cl.

| | |
|---|---|
| ***F25J 3/06*** | (2006.01) |
| ***F25J 3/08*** | (2006.01) |
| ***F25J 5/00*** | (2006.01) |
| ***F25J 3/04*** | (2006.01) |

(52) U.S. Cl.
CPC ..... *F25J 3/04393* (2013.01); *F25J 3/0605* (2013.01); *F25J 3/08* (2013.01); *F25J 5/005* (2013.01); *F25J 2200/10* (2013.01); *F25J 2200/50* (2013.01); *F25J 2200/70* (2013.01); *F25J 2200/92* (2013.01); *F25J 2200/94* (2013.01); *F25J 2205/24* (2013.01); *F25J 2210/42* (2013.01); *F25J 2210/50* (2013.01); *F25J 2245/40* (2013.01); *F25J 2250/10* (2013.01); *F25J 2250/20* (2013.01); *F25J 2290/34* (2013.01)

(56) References Cited

U.S. PATENT DOCUMENTS

| | | | | |
|---|---|---|---|---|
| 5,711,167 | A | 1/1998 | Ha et al. | |
| 2011/0097225 | A1* | 4/2011 | Freund | F02C 6/16 417/423.5 |

* cited by examiner

NITROGEN PRODUCTION METHOD AND NITROGEN PRODUCTION APPARATUS

CROSS REFERENCE TO RELATED APPLICATIONS

This application claims the benefit of priority under 35 U.S.C. § 119 (a) and (b) to Japanese patent application No. JP2018-51957, filed Mar. 20, 2018, the entire contents of which are incorporated herein by reference.

FIELD OF THE INVENTION

The present invention relates to a nitrogen production method for producing liquid nitrogen, and a nitrogen production apparatus.

BACKGROUND OF THE INVENTION

A method has been known for producing nitrogen gas and liquid nitrogen by a nitrogen production apparatus using cryogenic separation (for example, Japan Unexamined Patent Publication No. H11-316079 and U.S. Pat. No. 5,711,167). The liquid nitrogen may be collected from a nitrogen distillation column.

In the case that the quantity of liquid nitrogen produced is to be increased, a method for increasing the quantity of liquid nitrogen collected from the nitrogen distillation column or a method for liquefying the nitrogen gas produced may be considered.

Japan Unexamined Patent Publication No. H11-316079 discloses a method for increasing the quantity of liquid nitrogen produced by decreasing the quantity of nitrogen gas produced to increase the quantity of waste gas. To the extent that the quantity of waste gas is increased, the quantity of cold produced can be increased by adiabatic expansion of waste gas in an expansion turbine. This is because the cold can be recovered by a main heat exchanger to use in liquefying nitrogen.

U.S. Pat. No. 5,711,167 discloses a method for producing nitrogen gas and liquid nitrogen by collecting the cold of an oxygen-rich liquid by a main heat exchanger and a condenser, then generating and recovering the cold by an expansion turbine and a brake.

SUMMARY OF THE INVENTION

With the method disclosed in Japan Unexamined Patent Publication No. H11-316079, however, the nitrogen recovery rate is reduced because increasing the quantity of liquid nitrogen produced increases the quantity of waste gas. The quantity of cold recovered from nitrogen gas in the main heat exchanger drops with reduction in the quantity of nitrogen gas produced. This has the problem of increasing the load on the expansion turbine, which reduces energy efficiency.

With the method disclosed in U.S. Pat. No. 5,711,167, only a small quantity of liquid nitrogen can be directly recovered from the nitrogen distillation column.

Increasing the quantity of liquid nitrogen recovered from the nitrogen distillation column increases the load on the turbine, which reduces the heat exchange efficiency in the main heat exchanger.

In the case that the nitrogen gas produced by the method disclosed in U.S. Pat. No. 5,711,167 is liquefied to obtain liquid nitrogen, a liquefier must be used. A liquefier requires using many devices such as compressors to compress nitrogen in many stages, which raises equipment costs. Energy efficiency is also poor because energy loss during compression is great and the liquefier itself consumes much electricity.

Reflecting on this situation, an objective of the present invention is to provide a method for producing liquid nitrogen at a high nitrogen recovery rate and high energy efficiency.

In one embodiment of the invention, a method for producing a liquid nitrogen product comprises:

a precooling step for cooling at least a portion of feed air scrubbed of specified impurities to a first temperature and cooling the precooled feed air;

a cooling step for cooling at least a portion of the feed air cooled by the cooling step to a second temperature lower than the first temperature to produce a low-temperature feed air;

a first expanding step for expanding and cooling the other portion of the feed air cooled by the precooling step to produce a first low-temperature air;

a second expanding step for expanding and cooling at least a portion of the feed air to produce a second low-temperature air;

a first introducing step for expanding and introducing the feed air cooled by the cooling step into a lower section than a first distilling section in a distillation column having the first distilling section;

a condensing step for condensing at least a portion of the gas inside the distillation column by exchanging heat with an oxygen-rich liquid pooled in a lower section of the distillation column by a condensing section arranged in an upper section of the distillation column;

a recycled air compressing step for diverting waste gas (recycled air) removed from the condensing section arranged in an upper section of the distillation column and compressing the diverted waste gas;

a waste gas heat exchange step for exchanging heat between the not diverted waste gas and either the feed air or the precooled feed air;

a second introducing step for introducing the compressed recycled air compressed by the recycled air compressing step into a lower section of the distillation column than the location of the first distilling section; and a liquid nitrogen product removing step for removing a liquid nitrogen product from the distillation column.

In the precooling step and the cooling step, the feed air exchanges heat with the first low-temperature air and/or the second low-temperature air.

In another embodiment of the invention, the feed air compressed and scrubbed of specified impurities is cooled in a main heat exchanger by the precooling step and the cooling step to produce a low-temperature feed air. The low-temperature feed air is expanded by a feed air expansion valve, then introduced into the distillation column.

In another embodiment of the invention, a portion of the low-temperature feed air is liquefied in the main heat exchanger. The quantity of low-temperature feed air to be liquefied is, for example, 5 wt % to 90 wt %, and preferably 7 wt % to 75 wt %, of the low-temperature feed air. This liquefying quantity is proportional to the quantity of liquid nitrogen to be produced by the distillation column. Therefore, in the case that a large quantity of liquid nitrogen is to be produced, the quantity of liquefied feed air required is greatly increased. Proportionately increasing the quantity of liquefied feed air decreases the quantity of non-liquefied low-temperature feed air, resulting in an insufficient gas flow required to distill the low-temperature feed air in the distillation column. Increasing the liquefied quantity also impairs energy efficiency because great energy is required to cool the feed air.

Therefore, with certain embodiments of the present invention, a recycled air compressing step is disposed for compressing at least a portion of the gas (waste gas) evaporated by the condensing section arranged in an upper section of the distillation column as recycled air. 'At least a portion of the waste gas' is, for example, 20 wt % to 90 wt %, and preferably 40 wt % to 80 wt %, of the waste gas. The waste gas compressed in the recycled air compressing step may be supplied to the distillation column to assure the gas flow required for distillation. Redistilling waste gas as recycled air can improve the nitrogen recovery rate.

With certain embodiments of the present invention, a portion of the feed air is expanded and cooled in front of the main heat exchanger, and the remaining unexpanded feed air is used as cold for precooling inside the main heat exchanger. 'A portion of the feed air' is, for example, 1 wt % to 50 wt %, and preferably 3 wt % to 40 wt %, of the feed air.

In another embodiment of the invention, a portion of the feed air precooled inside the main heat exchanger is removed outside the main heat exchanger to expand and cool, and the remaining unexpanded precooled feed air is used as cold for cooling inside the main heat exchanger. 'A portion of the feed air precooled inside the main heat exchanger' is, for example, 1 wt % to 40 wt %, and preferably 5 wt % to 30 wt %, of the precooled feed air.

In another embodiment of the invention, using a portion of the feed air as cold in this way can improve energy efficiency in the case that a large quantity of feed air is to be liquefied.

In another embodiment of the invention, the feed air that was not liquefied in the main heat exchanger and liquefied feed air that was liquefied when decompressed by an expansion valve are introduced into the distillation column as gases. The low-temperature feed air introduced as a gas contacts liquid nitrogen supplied to a top section of the distillation column, and is rectified and separated into nitrogen gas and an oxygen-rich liquid. The oxygen-rich liquid pooled in a lower section of the distillation column is supplied as a coolant to the condensing section together with the liquefied feed air supplied to the distillation column.

In another embodiment of the invention, nitrogen gas is supplied from the top section of the distillation column to the condensing section, and liquefied. A portion of the resulting liquid nitrogen is supplied to the top section of the distillation column as reflux, and the other portion is removed from the nitrogen production apparatus as a liquid nitrogen product in the liquid nitrogen removing step. 'A portion of the liquid nitrogen' is, for example, 1 wt % to 60 wt %, and preferably 4 wt % to 50 wt %, of the liquid nitrogen.

To cool the removed liquid nitrogen product more, a portion of the liquid nitrogen product may be decompressed and used as a coolant. 'A portion of the liquid nitrogen product' is, for example, 1 wt % to 30 wt %, and preferably 5 wt % to 25 wt %, of the liquid nitrogen product. The liquid nitrogen that was cooled by decompressing exchanges heat in a subcooler with the liquid nitrogen that was not decompressed. As a result, the liquid nitrogen product is cooled more. The liquid nitrogen product may exchange heat in the subcooler with a first low-temperature air fed from a first expansion turbine to cool the liquid nitrogen product.

The portion of liquid nitrogen comprising a coolant may exchange heat with the other liquid nitrogen through the main heat exchanger.

A mixture of the oxygen-rich liquid supplied to the condensing section as a coolant and the liquefied feed air is evaporated by exchanging heat with nitrogen gas. A portion of the evaporated gas (waste gas) is supplied to the recycled air compressor as recycled air and compressed before supplying to a lower section of the distillation column.

The liquid nitrogen product produced by certain embodiments of the present invention is, for example, not less than 99% pure, and preferably not less than 99.9999% pure.

In another embodiment of the invention, the nitrogen production apparatus is provided with nitrogen production apparatuses (100; 101, 102; 103; and 104) provided with a main heat exchanger (1) for cooling feed air scrubbed of specified impurities;

a feed air expansion valve (4) for expanding the low-temperature feed air obtained by cooling feed air in the main heat exchanger to produce a portion of the low-temperature feed air as liquefied feed air; and a distillation column (5) having a first distilling section (18) to which the expanded low-temperature feed air is introduced;

and is provided with:

a main feed air supply line (28) for supplying feed air through the main heat exchanger (1) to the distillation column (5);

a first branch line (25) branching from the main feed air supply line (28) inside the main heat exchanger;

a first turbine (2) for expanding a first diverted feed air supplied by the first branch line (25) to produce a first low-temperature air;

a first low-temperature air introduction line (26) for introducing the first low-temperature air to the main heat exchanger (1);

a second branch line (23) branching from the main feed air supply line (28) in front of the main heat exchanger (1);

a second turbine (3) for expanding a second diverted feed air supplied by the second branch line (23) to produce a second low-temperature air having a lower temperature than the first low-temperature air;

a second low-temperature air introduction line (24) for introducing the second low-temperature air into the main heat exchanger (1);

a condensing section (9) arranged in an upper section of the distillation column;

an oxygen-rich liquid introduction line (31) for feeding at least a portion of oxygen-rich liquid from a lower section of the distillation column (5) and introducing the oxygen-rich liquid into the condensing section as a coolant;

a recycled air removal line (34) for removing at least a portion of waste gas (recycled air) from a location in the condensing section (9);

a recycled air compressor (12) for compressing at least a portion of the waste gas supplied by the recycled air removal line (34);

a recycled air introduction line (36) for introducing the compressed recycled air fed by the recycled air compressor (12) to the distillation column from a lower section of the distillation column than the location of the first distilling section (18);

a waste gas line (43) for removing a portion of the waste gas from the condensing section (9) to introduce into the main heat exchanger; and a liquid nitrogen product removal line (37) for removing liquid nitrogen from the distillation column.

The symbols in parentheses in the present specification indicate a first embodiment, but are not limited to this embodiment.

In another embodiment of the invention, the feed air compressed by the feed air compressor and scrubbed of specified impurities is precooled and cooled in the main heat exchanger to produce a low-temperature feed air. The low-temperature feed air is expanded by the feed air expansion valve, then introduced into the distillation column.

In another embodiment, a portion of the low-temperature feed air is liquefied in the main heat exchanger. To increase the quantity liquefied while maintaining high energy efficiency, the nitrogen production apparatus according to the present invention has a first turbine and a second turbine. The quantity of low-temperature feed air liquefied is, for example, 5 wt % to 90 wt %, and preferably 7 wt % to 75 wt %, of the low-temperature feed air.

In another embodiment, the first turbine expands and cools a portion of the feed air removed outside the main heat exchanger and precooled inside the main heat exchanger. The feed air cooled by the first turbine is supplied to the cold side of the main heat exchanger and used as cold to cool the feed air expanded by the first turbine inside the main heat exchanger. 'A portion of the feed air precooled inside the main heat exchanger' is, for example, 1 wt % to 40 wt %, and preferably 5 wt % to 30 wt %, of the feed air precooled inside the main heat exchanger.

In another embodiment, the second turbine expands and cools a portion of the feed air diverted in front of the main heat exchanger. The feed air cooled by the second turbine is supplied to a midsection of the main heat exchanger, and is used as cold to precool the feed air not expanded by the second turbine inside the main heat exchanger. 'A portion of the feed air diverted in front of the main heat exchanger' is, for example, 1 wt % to 50 wt %, and preferably 3 wt % to 40 wt %, of the feed air.

Using a portion of the feed air as cold in this way can improve energy efficiency in the case that a large quantity of feed air is to be liquefied.

In another embodiment, the nitrogen production apparatus can further include a recycled air compressor for compressing at least a portion of the gas (waste gas) evaporated by a condensing section arranged in an upper section of the distillation column. 'A portion of the waste gas' is, for example, 20 wt % to 90 wt %, and preferably 40 wt % to 80 wt %, of the waste gas. The compressed recycled air compressed by the recycled air compressor is supplied to the distillation column and rectified. The compressed recycled air may be introduced into the main heat exchanger and cooled before supplying to the distillation column. Introducing recycled air into the distillation column in addition to the feed air can assure the gas flow required for rectification. Redistilling the waste gas as recycled air can also improve the nitrogen recovery rate.

In another embodiment, of the waste gas evaporated in the condenser, the portion not introduced into the recycled air compressor is introduced by a waste gas line into the main heat exchanger and used as cold to exchange heat with the feed air inside the main heat exchanger.

Using waste gas as cold in this way can improve the energy efficiency of the nitrogen production apparatus according to the present invention.

In another embodiment, the condensing section (9) of the nitrogen production apparatus according to either of the inventions described earlier may be provided with a second condenser (6) and a first condenser (7). The recycled air removal line (34) in the nitrogen production apparatus is arranged in the condensing section so as to introduce at least a portion of the gas to be evaporated by the first condenser (7) into the recycled air compressor (12). The waste gas line (43) may be arranged so as to introduce at least a portion of the gas to be evaporated by the second condenser (6) into the main heat exchanger (1).

In any of the inventions described earlier, an oxygen-rich liquid may be supplied to the first condenser (7) through the oxygen-rich liquid introduction line (31) before supplying to the second condenser (6).

In another embodiment, the evaporation lateral pressures of the second condenser and the first condenser are the same, but may be different. In the case that the evaporation lateral pressures are different, the gas evaporated by the second condenser may be supplied to the main heat exchanger as waste gas, and the gas evaporated by the first condenser may be supplied to the recycled air compressor.

In another embodiment, the oxygen-rich liquid is introduced from a bottom section of the distillation column (5) to the condensing section through the oxygen-rich liquid introduction line (31). The oxygen-rich liquid may be introduced first to the first condenser, then to the second condenser. By introducing the oxygen-rich liquid in this way, the first condenser and the second condenser may have different evaporation pressures.

In another embodiment, the gas discharged by the first condenser having a higher evaporation lateral pressure is compressed and rectified again by the distillation column as recycled air. The waste gas discharged by the second condenser having a lower evaporation lateral pressure is used as cold in the main heat exchanger, then discharged. Configuring in this way so as to compress the waste gas having a higher pressure allows the gas to be compressed efficiently.

In another embodiment, the waste gas supplied to the main heat exchanger is used as cold to exchange heat with the feed air inside the main heat exchanger. Using the waste gas as cold in this way can improve the energy efficiency of the nitrogen production apparatus according to the present invention.

In another embodiment, the gas supplied to the recycled air compressor is compressed, supplied to the distillation column as recycled air, and rectified. Introducing recycled gas into the distillation column in addition to the feed air can assure the gas flow required for rectification. Redistilling the waste gas as recycled air can also improve the nitrogen recovery rate.

The nitrogen production apparatus according to any of the inventions described earlier may also be provided with a third turbine (13) for expanding the waste gas supplied by the waste gas line (43) through the main heat exchanger (1) to produce a low-temperature waste gas, and a shaft end of the third turbine (13) may be connected to a shaft end of the recycled air compressor (12).

In another embodiment, the waste gas releasing cold by exchanging heat with the feed air inside the main heat exchanger is introduced into the third turbine. The introduced waste gas is expanded and cooled by the third turbine to produce a low-temperature waste gas. The resulting low-temperature waste gas is reintroduced into the main heat exchanger, and may be used as cold to exchange heat with the feed air. Coupling the third turbine to the recycled air compressor and using the resulting power to compress the recycled air by the third turbine can improve energy efficiency. Using cold in this way can improve the energy efficiency of the nitrogen production apparatus.

The nitrogen production apparatus according to any of the inventions described earlier may also be provided with a compressed recycled air cooling line (42) for cooling the compressed recycled air by the main heat exchanger (1).

In another embodiment, the compressed recycled air fed from the recycled compressor may be introduced directly into the distillation column, or may be cooled by the main heat exchanger before introducing into the distillation column. Cooling by the main heat exchanger allows the cold introduced into the main heat exchanger to be used effectively and can improve the energy efficiency of the nitrogen production apparatus.

In another embodiment, the distillation column (5) of the nitrogen production apparatus may be provided with a second distilling section (19) arranged below the first distilling section (18). With such a nitrogen production apparatus, the feed liquid nitrogen is introduced into a section that is lower than the location of the first distilling section (18) and higher than the location of the second distilling section (19), and the compressed recycled air is introduced into a section that is lower than the location of the second distilling section (19).

The recycled air has a higher oxygen concentration than the feed air. Therefore, introducing the recycled air below the feed air when introducing into the distillation column can increase rectification efficiency.

In another embodiment, the nitrogen production apparatus may also be provided with a first compressor (14) for further compressing the feed air compressed by the feed air compressor and scrubbed of specified impurities in a scrubbing section;

a first cooler (16) for cooling the feed air fed from the first compressor (14);

a second compressor (15) for further compressing the feed air fed from the first cooler (16); and a second cooler (17) for cooling the feed air fed from the second compressor (15).

In another embodiment, a shaft end of the second turbine (3) is connected to a shaft end of the first compressor (14) and/or the second compressor (15). Likewise, a shaft end of the first turbine (2) is connected to a shaft end of the first compressor (14) and/or the second compressor (15). As a result, the power of the first turbine can be used to compress the feed air the first compressor (14) and/or the second compressor (15). Likewise, the power of the second turbine can be used to compress the feed air the first compressor (14) and/or the second compressor (15). This can further increase energy efficiency.

In another embodiment, the first feed air cooler (16) for cooling the feed air compressed by the first compressor may be arranged in back of the first compressor (14). The second feed air cooler (17) for cooling the feed air compressed by the second compressor may be arranged in back of the second compressor (15).

In another embodiment, the shaft ends of the first turbine, the second turbine, and the third turbine may be independently connected to at least one shaft end of any of the recycled air compressor, the first compressor, and the second compressor.

The nitrogen production apparatus according to the present invention may also include:

a feed air compressor (61) for compressing air taken in from outside; and a scrubbing section (62) for scrubbing specified impurities from the air compressed by the feed air compressor to produce a feed air.

According to the nitrogen production apparatus described earlier, all or a portion of the nitrogen collected by the nitrogen production apparatus can be removed as liquid nitrogen. Therefore, a liquefier for liquefying nitrogen gas is not required, and liquid nitrogen can be produced by a simpler and cheaper apparatus. The inventions described earlier do not require compressing nitrogen gas, but compress only air, and thus can improve energy efficiency compared with generating cold by a refrigerating cycle using nitrogen as the working fluid.

BRIEF DESCRIPTION OF THE DRAWINGS

Further developments, advantages and possible applications of the invention can also be taken from the following description of the drawing and the exemplary embodiments. All features described and/or illustrated form the subject-matter of the invention per se or in any combination, independent of their inclusion in the claims or their back-references.

DETAILED DESCRIPTION OF THE INVENTION

Several embodiments of the present invention will be described hereinafter. The embodiments described hereinafter are examples of the present invention. The present invention is not to be taken as limited in any way to these embodiments, and includes various modifications and variations without departing from the scope of the present invention. The essential configurations of the present invention are not limited to all of the configurations described hereinafter.

The flow of the nitrogen production method according to the present invention will be described with reference to FIG. 1.

Compressing Step

Figure 1:
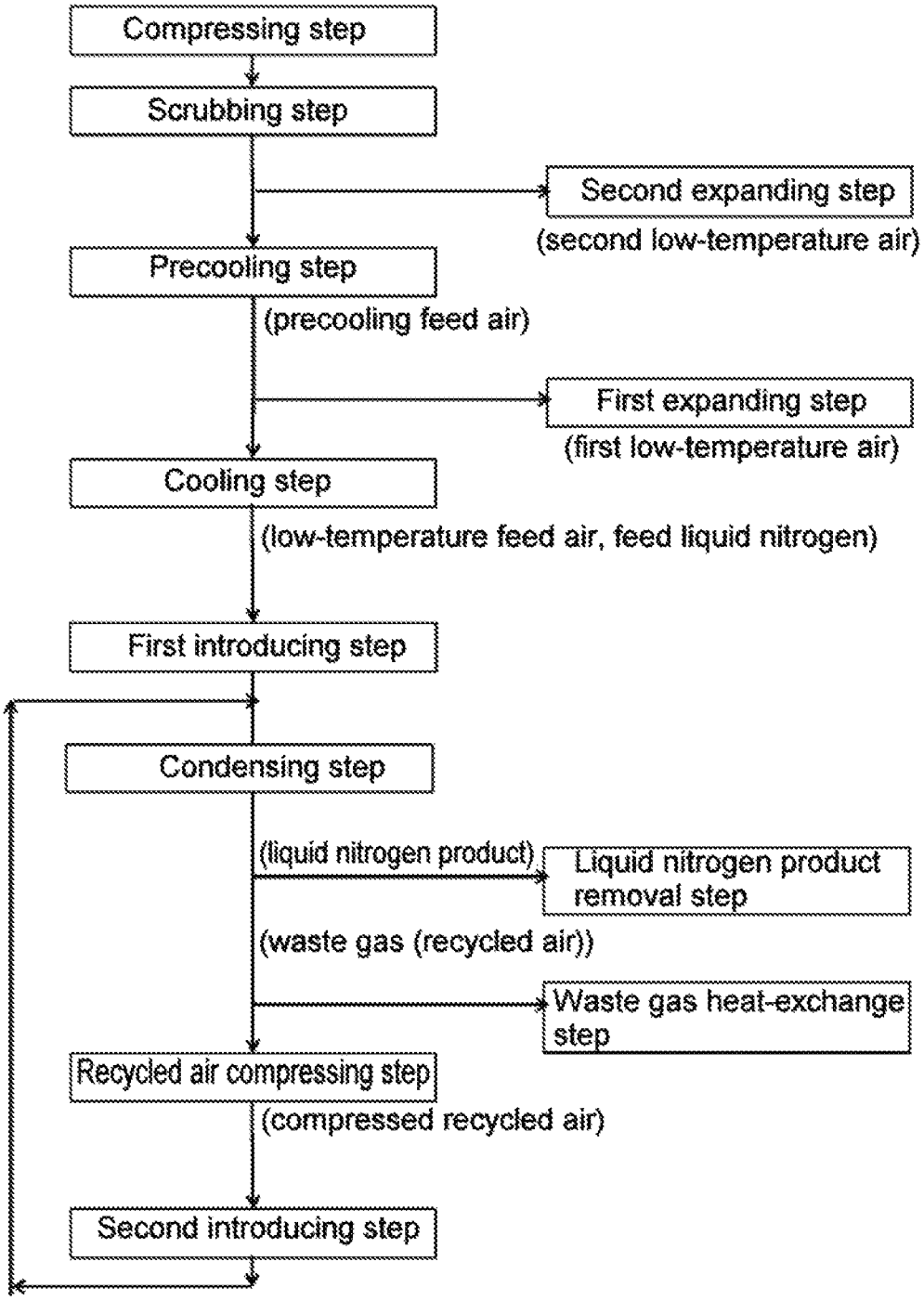
FIG. 1 is a flow diagram showing the steps of the nitrogen production method according to the embodiments.

The compressing step indicated in FIG. 1 is a step for compressing feed air taken in from outside by one or a plurality of compressors. In the case that the feed air is compressed using a plurality of compressors, a plurality of cooling steps may be included for cooling the feed air compressed by each of the compressors.

Figure 2:
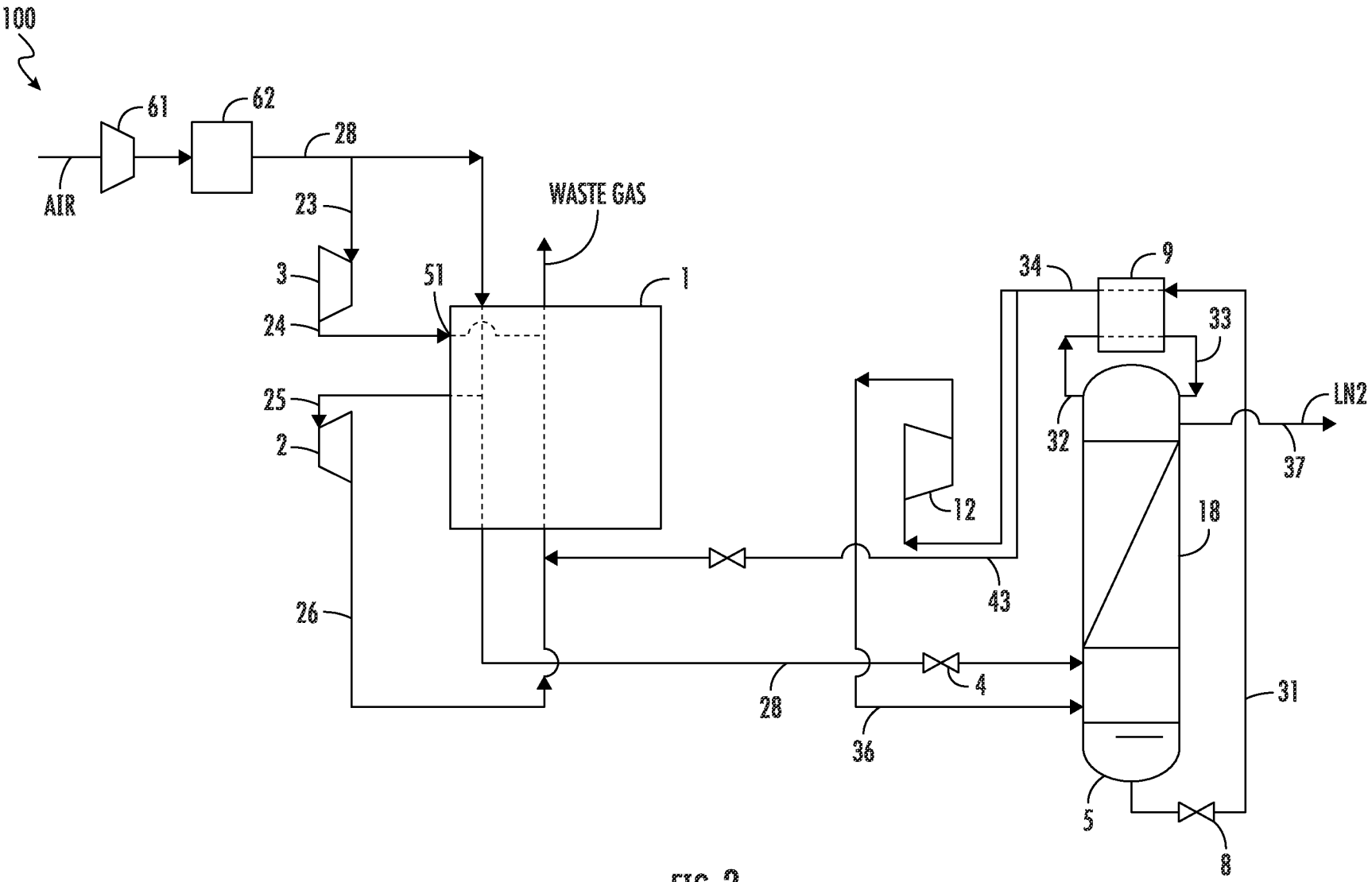
FIG. 2 is a diagram showing a configuration example of the nitrogen production apparatus of Embodiment 1.

With the nitrogen production apparatus 100 shown in FIG. 2, the compressing step is achieved by the feed air compressor 61.

The compressing step may be included or omitted, and in the case that the compressing step is omitted, a step for introducing compressed feed air from outside may be included.

Scrubbing Step

The scrubbing step is a step for scrubbing specified impurities from the feed air compressed in the compressing step. Although not specifically limited, the method for scrubbing impurities in the scrubbing step may be a conventional method such as adsorption or cooling. The impurities to be scrubbed are not specifically limited, and may include moisture and carbon dioxide gas, which are a source of obstruction of parts such as heat exchangers.

Of the feed air scrubbed of specified impurities in the scrubbing step, a portion is delivered to the second expanding step. The feed air not delivered to the second expanding step is delivered to the precooling step.

In FIG. 2, the scrubbing step is performed in the scrubbing section 62.

The scrubbing step may be included or omitted, and in the case that the scrubbing step is omitted, a step for introducing compressed feed air scrubbed of specified impurities from outside may be included.

The compressing step and the scrubbing step may be performed, or either one or both may not be performed. In the case that the compressing step is not performed, air having a predetermined pressure may be received. In the case that the scrubbing step is not performed, air having no more than a predetermined content of impurities may be received.

Second Expanding Step

The second expanding step is a step for expanding and cooling at least a portion of the feed air scrubbed of specified impurities in the scrubbing step. The expanded and cooled feed air is a second low-temperature air. An expansion turbine (indicated by 3 in FIG. 2) is used to expand and cool the feed air.

The second low-temperature air fed from the expansion turbine in the second expanding step is introduced into a midsection of the main heat exchanger (indicated by 1 in FIG. 2), where the air exchanges heat in a precooling step (described hereinafter) with feed air not passed through the second expanding step, then is fed from the hot side of the main heat exchanger.

The location where the second low-temperature air is introduced into the main heat exchanger (the first introduction location; indicated by 51 in FIG. 2) need only be between the hot side and the cold side of the main heat exchanger, and may be from the center between the hot and cold sides to the cold side of the main heat exchanger. If the feed air not passed through the second expanding step has a temperature of $T_{in}$ when introduced into the main heat exchanger and a temperature of $T_{out}$ when fed from the main heat exchanger, the first introduction location may be a location where the temperature of the feed air not passed through the second expanding step ($T_{m1}$) is lower than $T_{in}$ and higher than $T_{out}$. The range of the temperature $T_{m1}$ is preferably the range established by the following expression (1).

$$T_{in}-(T_{in}-T_{out})\times 0.9<T_{m1}<T_{in}-(T_{in}-T_{out})\times 0.5 \quad (1)$$

Precooling Step

The precooling step is a step for cooling at least a portion of the feed air scrubbed of specified impurities in the scrubbing step to a first temperature to produce precooled feed air.

Like $T_{m1}$, the first temperature is a temperature lower than $T_{in}$ and higher than $T_{out}$.

In the precooling step, the feed air not passed through the second expanding step exchanges heat with the second low-temperature air and/or the first low-temperature air described hereinafter.

A portion of the feed air passed through the precooling step is delivered to the cooling step. Of the feed air passed through the precooling step, the feed air not delivered to the precooling step is delivered to the first expanding step.

Cooling Step

The cooling step is a step for cooling at least a portion of the feed air cooled in the precooled step to a second temperature lower than the first temperature to produce a low-temperature feed air. The second temperature is a temperature like $T_{out}$.

In the cooling step, the feed air passed through the precooling step exchanges heat with the first low-temperature air described hereinafter.

First Expanding Step

The first expanding step is a step for expanding and cooling at least a portion of the feed air cooled in the precooling step. The expanded and cooled feed air is a first low-temperature air. An expansion turbine is used to expand and cool the feed air.

The first low-temperature air fed from the expansion turbine in the first expanding step is introduced into the cold side of the main heat exchanger, where it exchanges heat with the feed air precooled in the cooling step, then is fed from the hot side of the main heat exchanger.

First Introducing Step

The first introducing step is a step for introducing the low-temperature feed air obtained by cooling feed air in the cooling step to a distillation column (indicated by 5 in FIG. 2). The distillation column has a first distilling section. The low-temperature feed air is introduced into a section of the distillation column lower than the location of the first distilling section.

Before introducing into the distillation column, a portion of the low-temperature feed air may be expanded by passing through an expansion valve (feed air expansion valve, indicated by 4 in FIG. 2), and a portion may be liquefied to produce a feed liquid nitrogen.

The low-temperature feed air introduced into the distillation column by the first introducing step and the feed liquid nitrogen are rectified and separated into an oxygen-rich liquid and nitrogen gas.

The oxygen-rich liquid is supplied to the condensing section as a coolant together with the feed liquid nitrogen supplied to the distillation column.

The nitrogen gas is supplied from the distilling section of the distillation column to the condensing section (9 in FIG. 2) and liquefied.

Liquid Nitrogen Product Removal Step

A portion of the liquid nitrogen obtained by distillation is supplied to the top of the distillation column, and the remaining portion is removed from the nitrogen production apparatus as the liquid nitrogen product in the liquid nitrogen removal step (37 in FIG. 2).

To cool the removed liquid nitrogen product more, a portion of the liquid nitrogen may be compressed and used as a coolant. The liquid nitrogen partially used as a coolant may exchange heat with the other liquid nitrogen through the main heat exchanger. The liquid nitrogen product may also exchange heat using a subcooler.

Recycled Air Compressing Step

The recycled air compressing step is a step for compressing waste gas (recycled air) removed from a condensing section arranged in an upper section of the distillation column by a compressor (12 in FIG. 2). A portion of the waste gas removed from the condensing section is delivered to the recycled air compressing step. The waste gas not delivered to the recycled air compressing step may be supplied to the cold side of the main heat exchanger, and the waste gas may exchange heat in the main heat exchanger with the feed air and/or the precooled feed air.

Second Introducing Step

The second introducing step is a step for introducing the compressed recycled air compressed in the recycled air compressing step into a section of the distillation column lower than the location of the first distilling section. In the case that the distillation column has a second distilling section arranged below the first distilling section, the recycled air may be introduced into a section lower than the location of the second distilling section.

Embodiment 1

The nitrogen production apparatus of Embodiment 1 will be described with reference to FIG. 2.

The nitrogen production apparatus 100 according to Embodiment 1 is provided with a feed air compressor 61, a scrubbing section 62, a main heat exchanger 1, a feed air expansion valve 4, and a distillation column 5. The distillation column 5 has a first distilling section 18 and a condensing section 9.

The nitrogen production apparatus 100 is also provided with a main feed air supply line 28, a first branch line 25, a first turbine 2, a first low-temperature air introduction line 26, a second branch line 23, a second turbine 3, a second low-temperature air introduction line 24, a recycled air removal line 34, a waste gas line 43, a recycled air compressor 12, a recycled air introduction line 36, and a liquid nitrogen product removal line 37.

The nitrogen production apparatus 100 is an apparatus for producing liquid nitrogen by cryogenic separation. The apparatus may produce only liquid nitrogen, or may produce nitrogen gas as well as liquid nitrogen.

The feed air compressor 61 is a compressor for compressing feed air taken in from outside (for example, a feed air quantity of 1000 $Nm^3/h$).

The scrubbing section 62 is a purification unit for scrubbing specified impurities. This section may be a unit for purifying using a conventional method such as adsorption or cooling. The impurities to be scrubbed are not specifically limited, and may be carbon dioxide gas, moisture, and the like, which are a source of obstruction of parts such as heat exchangers.

The main heat exchanger 1 is a heat exchanger for cooling the feed air scrubbed of impurities by the scrubbing section. Inside the main heat exchanger 1, the feed air exchanges heat with a first low-temperature air and/or a second low-temperature air described hereinafter.

In the main heat exchanger 1, the feed air is cooled to a first temperature to produce precooled feed air, then the precooled feed air is cooled to a second temperature to produce a low-temperature feed air. The low-temperature feed air may be gaseous or partially liquefied. The feed air has a temperature of, for example, −40° C. when introduced into the main heat exchanger 1, and is cooled to a first temperature (for example, −90° C.) to produce precooled feed air.

The second branch line 23 is a line that branches from the main feed air supply line 28 in front of the main heat exchanger 1. A portion of the feed air passing through the scrubbing section 62 is supplied to the main heat exchanger 1 through the main feed air supply line 28, and the other portion is diverted to the second branch line 23. The feed air is introduced into the second turbine 3 through the second branch line 23.

The second turbine 3 is an expansion turbine for expanding the second diverted feed air supplied by the second branch line 23 to produce a second low-temperature air. The feed air becomes the second low-temperature air by expanding and cooling in the second turbine 3. The temperature of the second low-temperature air is, for example, −180° C. to −192° C.

The second low-temperature air fed from the second turbine 3 is introduced into a middle section of the main heat exchanger 1, exchanges heat with the feed air not passed through the second turbine 3, then is fed from the hot side of the main heat exchanger 1. The second low-temperature air introduction line 24 is a line for introducing the second low-temperature air from the second turbine 3 into the main heat exchanger 1.

The location where the second low-temperature air is introduced into the main heat exchanger 1 (first introduction location 51) may be anywhere between the hot and cold sides of the main heat exchanger 1, and may be closer to the hot side than the center between the hot and cold sides of the main heat exchanger 1. If the feed air not passing through the second turbine 3 has a temperature of $T_{in}$ when introduced into the main heat exchanger 1 and a temperature of $T_{out}$ when fed from the main heat exchanger 1, the first introduction location 51 may be a location where the temperature ($T_{m1}$) of the feed air not passing through the second turbine 3 is lower than $T_{in}$ and higher than $T_{out}$. The range of the temperature $T_{m1}$ is preferably the range established by the following expression (1).

$$(T_{in}+T_{out})\times 0.5<T_{m1}<(T_{in}+T_{out})\times 0.9 \quad (1)$$

The second low-temperature air introduced from the second low-temperature air introduction line 24 into the main heat exchanger 1 exchanges heat with the feed air not passing through the second turbine 3, then is discharged outside the main heat exchanger 1.

The first branch line 25 is a line branching from the main feed air supply line 28 inside the main heat exchanger. The feed air introduced through the main feed air supply line 28 into the main heat exchanger 1 is cooled to a first temperature to produce precooled feed air. A portion of this precooled feed air is diverted through the first branch line 25 and supplied to the first turbine 2 arranged outside the main heat exchanger 1.

The first turbine 2 is an expansion turbine for expanding the first diverted feed air supplied by the first branch line 25 to produce a first low-temperature air. The precooled feed air not supplied to the first turbine 2 is further cooled inside the main heat exchanger 1 to produce a low-temperature feed air.

The precooled feed air is expanded and cooled by the first turbine 2 to produce a first low-temperature air. The temperature of the first low-temperature air is, for example, −90° C. to −110° C. The first low-temperature air introduction line 26 is a line for introducing the first low-temperature air into the main heat exchanger 1.

The first low-temperature air introduced through the first low-temperature air introduction line 26 into the main heat exchanger 1 exchanges heat with the feed air not passed through the first turbine 2 and the second turbine 3, then is discharged outside from the hot side of the main heat exchanger 1.

The feed air expansion valve 4 is an expansion valve for expanding the low-temperature feed air obtained by cooling feed air in the main heat exchanger.

The main feed air supply line 28 is a line for supplying the feed air passed through the main heat exchanger 1 into the distillation column 5.

The low-temperature feed air and the feed liquid nitrogen passing through the feed air expansion valve 4 are introduced into the distillation column 5, and boosted and rectified in the distillation column 5. The distillation column 5 has a first rectifying section 18 arranged below and a condensing section 9 arranged in an upper portion of the column. The distillation column 5 has an operating pressure in a range of 5-20 barA, and the operating pressure may be, for example, 9 barA. The number of theoretical stages of the distillation column 5 is 40-100, and may be, for example, 60 stages. Rectification in the first rectifying section separates an oxygen-rich liquid in a lower section of the distillation column 5 and nitrogen gas in an upper section of the distillation column 5. At least a portion of the oxygen-rich liquid is fed from the lower section of the distillation column 5, introduced through the oxygen-rich liquid introduction line 31 into the condensing section 9, and cooled by the condensing section 9.

A waste gas containing many low boiling point impurities is separated in the condensing section 9. The recycled air removal line 34 is a line for removing waste gas (recycled air) from a location in the condensing section 9. The location of the recycled air removal line 34 may be any location from which gas can be fed from the condensing section, and is preferably an upper section of the condensing section 9.

The recycled air compressor 12 is a compressor for compressing at least a portion of the waste gas supplied by the recycled air removal line 34 to produce compressed recycled air.

The recycled air introduction line 36 is a line for introducing the compressed recycled air fed from the recycled air compressor 12 into the distillation column 5 from a lower section than the location of the first rectifying section 18 in the distillation column. The compressed recycled air is rectified inside the distillation column 5 together with the low-temperature feed air and the feed liquid nitrogen supplied by the main feed air supply line 28.

A portion of the waste gas may be introduced into the recycled air compressor 12, and the waste gas not delivered to the recycled air compressor 12 may be diverted through the waste gas line 43 to the first low-temperature air introduction line 26 and introduced into the main heat exchanger 1. The waste gas line 43 may be a line leading directly from the condensing section 9 to the main heat exchanger 1, or may be a line branching from the recycled air removal line 34 before leading to the main heat exchanger 1.

Figure 3:
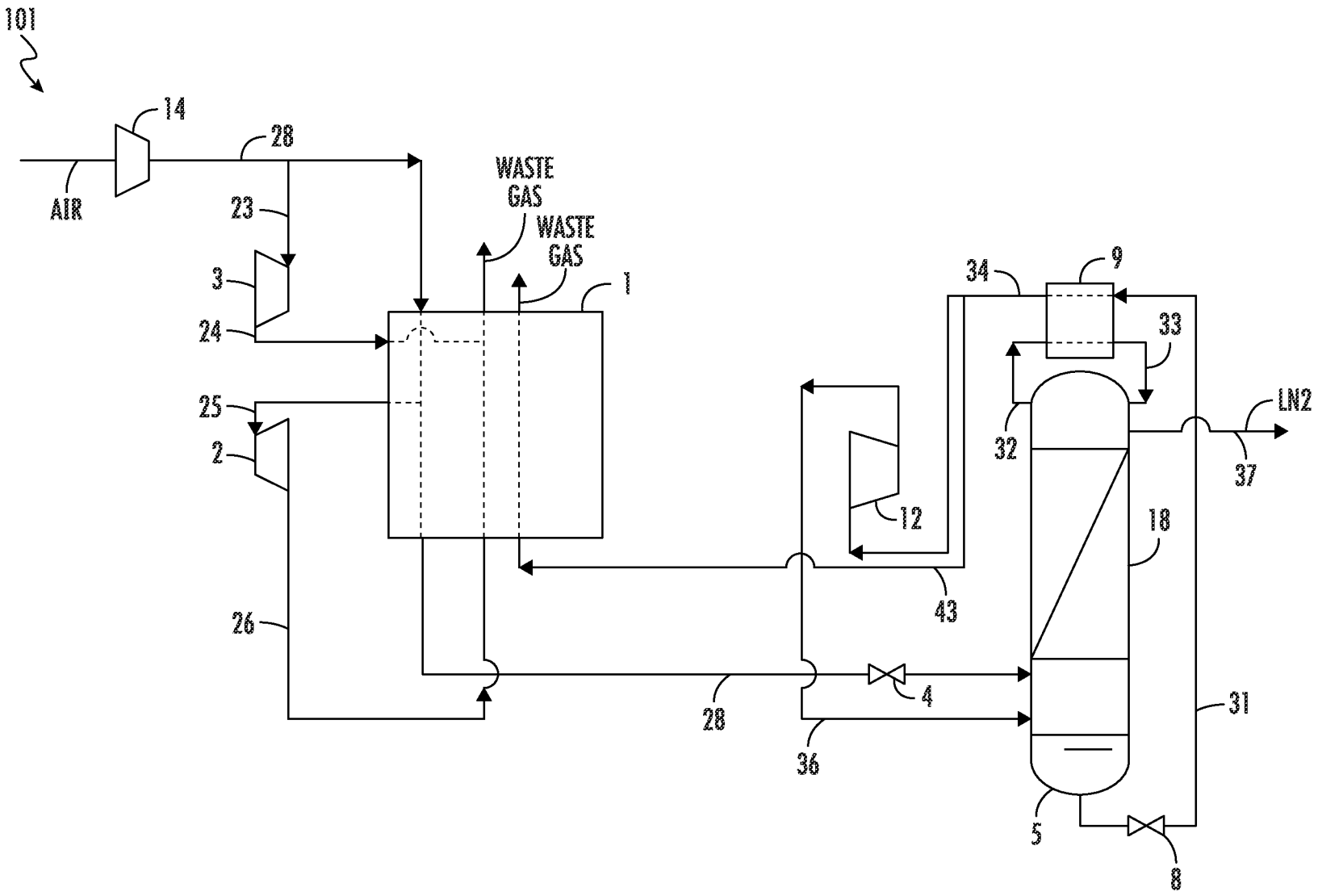
FIG. 3 is a diagram showing another configuration example of the nitrogen production apparatus of Embodiment 1.

Waste gas may be introduced directly from the waste gas line 43 into the cold side of the main heat exchanger 1, without merging with the first low-temperature air introduction line 26, and fed from the hot side of the main heat exchanger 1 after exchanging heat, as with the nitrogen production apparatus 101 shown in FIG. 3.

The waste gas introduced through the waste gas line 43 into the cold side of the main heat exchanger 1 exchanges heat with the feed air and/or precooled feed air inside the main heat exchanger 1, then is fed from the hot side of the main heat exchanger 1.

Figure 4:
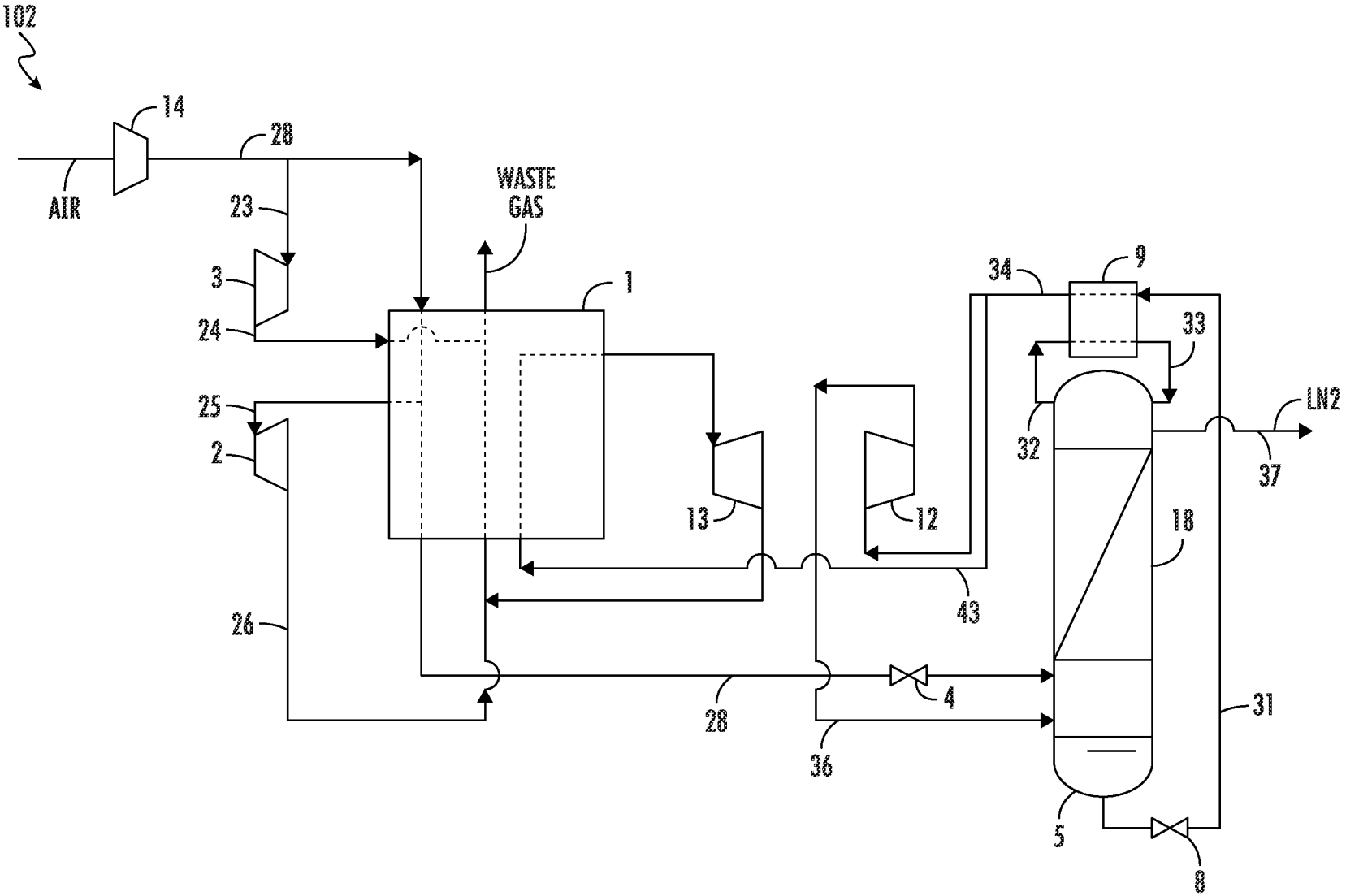
FIG. 4 is a diagram showing another configuration example of the nitrogen production apparatus of Embodiment 1.

A third turbine 13 may also be provided for expanding the waste gas supplied by the waste gas line 43 through the main heat exchanger 1 to produce a low-temperature waste gas, as with the nitrogen production apparatus 102 shown in FIG. 4. The low-temperature waste gas discharged by the third turbine 13 may exchange heat with feed air and/or precooled feed air in the main heat exchanger 1 before feeding from the hot side of the main heat exchanger 1. The cold of the low-temperature waste gas can be used by configuring in this way.

The third turbine 13 may also be linked to the recycled air compressor 12 (not shown). By configuring in this way, the power recovered by the third turbine 13 can be used to compress the recycled air, improving power efficiency.

The recycled air removal line 34 is a line for removing the liquid nitrogen product from the distillation column. The liquid nitrogen product boosted in the distillation column 5, condensed in the condensing section 9, and reintroduced into the distillation column 5 as reflux is removed from the recycled air removal line 34.

Another possible embodiment may be a nitrogen production apparatus without the feed air compressor 61 and the scrubbing section 62. In this case, feed air that has been compressed and scrubbed of specified impurities is received from outside, and supplied to the nitrogen production apparatus 100 by the main feed air supply line 28.

Embodiment 2

The nitrogen production apparatus 103 of Embodiment 2 will be described with reference to FIG. 5. Elements labelled with the same reference numerals as the nitrogen production apparatus 100 of Embodiment 1 have the same function, and will not be described again.

Figure 5:
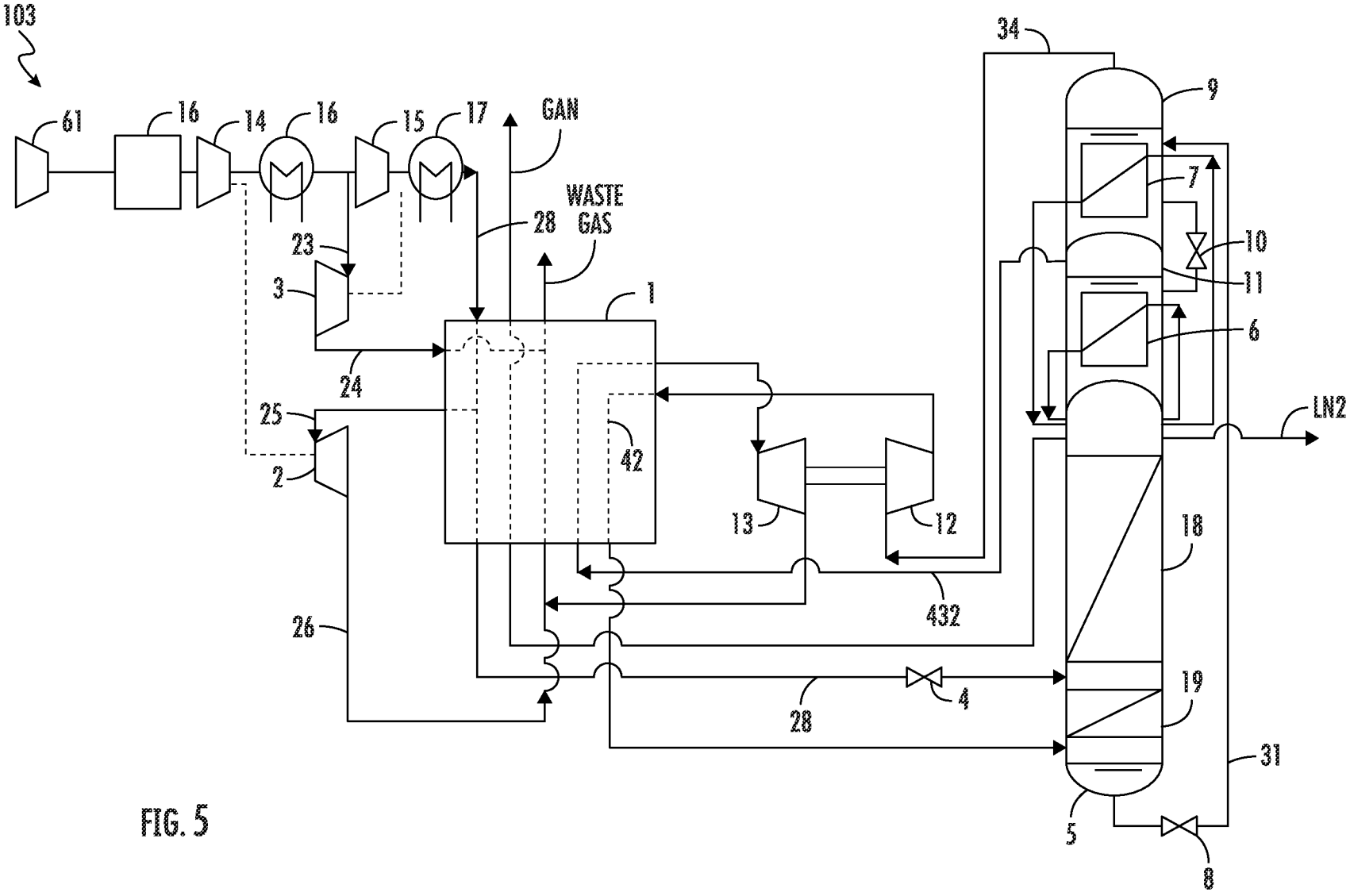
FIG. 5 is a diagram showing a configuration example of the nitrogen production apparatus of Embodiment 2.

As shown in FIG. 5, the condensing section 9 may be provided with a second condenser 6 and a first condenser 7 arranged in an upper section of the second condenser 6. The recycled air removal line 34 is arranged in the condensing section so as to introduce at least a portion of the gas evaporated by the first condenser 7 into the recycled air compressor 12. The condensing section 9 is provided with a waste gas line 432 for introducing at least a portion of the gas evaporated by the second condenser 6 into the main heat exchanger 1.

The first condenser 7 may have a higher evaporation lateral pressure than the second condenser 6 (for example, 6.5 barA in the first condenser 7 as opposed to 5 barA in the second condenser 6). Making the pressure of the condenser arranged in the upper section (that is, the first condenser 7) higher than the pressure of the condenser arranged in the lower section (that is, the second condenser 6) can increase the suction pressure of the recycled air compressor and improve energy efficiency.

At least a portion of the waste gas (recycled air) evaporated by the first condenser 7 is introduced through the recycled air removal line 34 into the recycled air compressor 12. The waste gas is made into compressed recycled air by the recycled air compressor 12. The compressed recycled air may be introduced into the distillation column 5 as is, or may be cooled before introducing into the distillation column 5. The compressed recycled air may be cooled using a free-standing cooler (not shown), or may be introduced through the compressed recycled air cooling line 42 into the main heat exchanger 1 and cooled by exchanging heat inside the main heat exchanger 1.

At least a portion of the gas evaporated by the second condenser 6 is introduced through the waste gas line 432 into the main heat exchanger 1. After releasing cold by exchanging heat with feed air and/or precooled feed air in the main heat exchanger 1, the waste gas may be fed from the hot side of the main heat exchanger 1 or introduced into the third turbine 13. The waste gas is expanded and cooled in the third turbine 13 to produce a low-temperature waste gas (with a temperature of, for example, −175° C.). The low-temperature waste gas is reintroduced into the main heat exchanger 1 through a low-temperature waste gas discharge line 41, and releases cold by heat exchange.

A shaft end of the third turbine 13 may be connected to a shaft end of the recycled air compressor 12. By connecting in this way, the power recovered by the third turbine 13 can be used to operate the recycled air compressor 12, which can improve power efficiency.

In Embodiments 1 and 2, a plurality of compressors may be arranged for compressing feed air taken in from outside; for example, a first compressor 14 and a second compressor 15, for further compressing the feed air compressed by the first compressor 14, may be provided as shown in FIG. 5. Coolers for cooling the feed air compressed by the compressors may be arranged after the first compressor 14 and the second compressor 15 (for example, a first cooler 16 arranged after the first compressor 14 and a second cooler 17 arranged after the second compressor 15).

A shaft end of the first turbine 2 may be connected to a shaft end of the first compressor 14 to use the power recovered by the first turbine 2 to operate the first compressor 14. Similarly, a shaft end of the second turbine 3 may be connected to a shaft end of the second compressor 15 to use the power recovered by the second turbine 3 to operate the second compressor 15.

As another embodiment, the shaft ends of the first turbine, the second turbine, and the third turbine may be independently connected to at least one of any of the recycled air compressor, the first compressor, and the second compressor.

In Embodiments 1 and 2, a plurality of rectifying sections may be disposed in a lower section of the distillation column 5. For example, the distillation column 5 may be provided with a second rectifying section 19 arranged below the first rectifying section 18. In this case, liquefied feed air and low-temperature feed air may be introduced into a section that is lower than the location of the first rectifying section 18 and higher than the location of the second rectifying section 19. Compressed recycled air may also be introduced into a section lower than the location of the second rectifying section 19.

Embodiment 3

Figure 6:
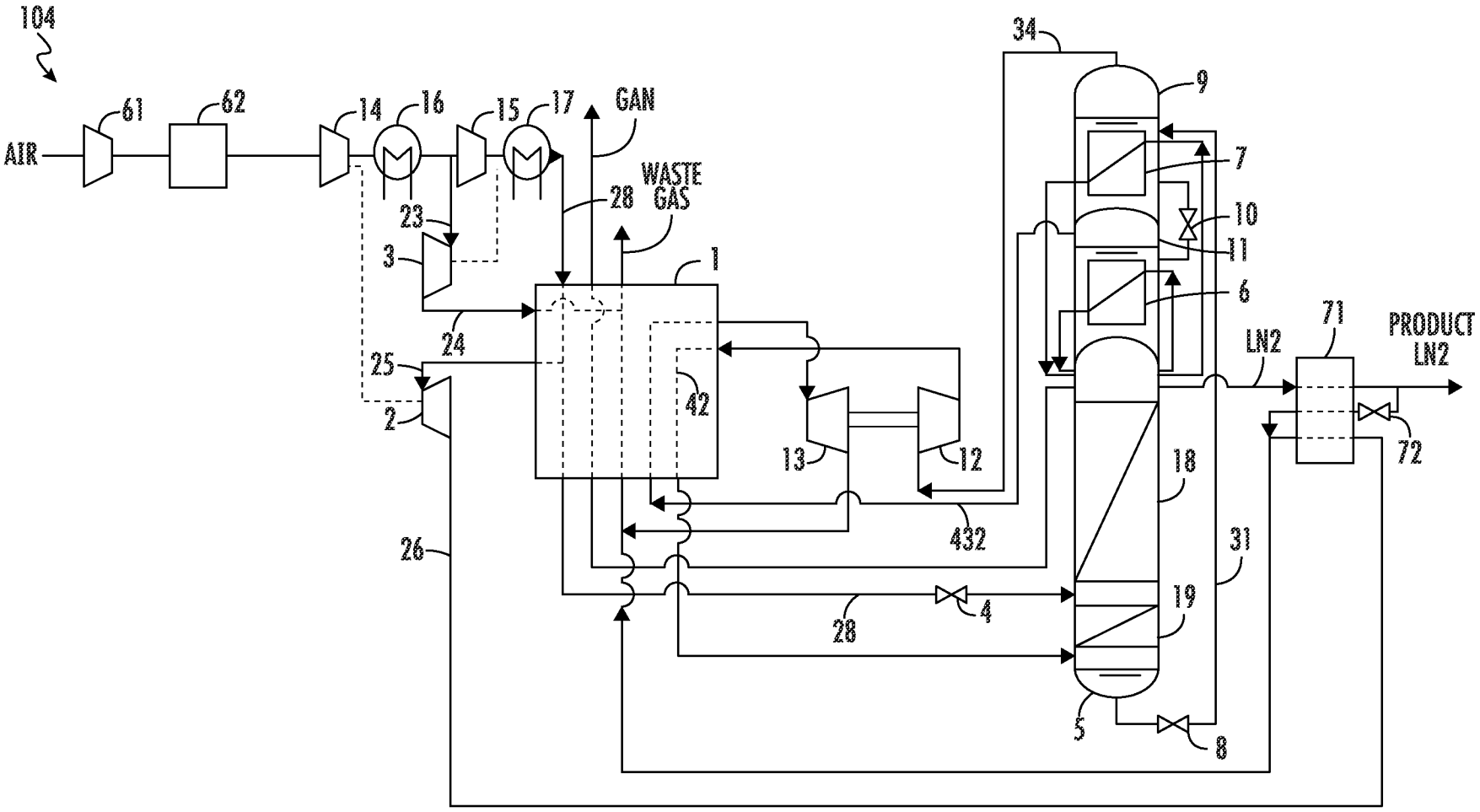
FIG. 6 is a diagram showing a configuration example of the nitrogen production apparatus of Embodiment 3.

The nitrogen production apparatus 104 of Embodiment 3 will be described with reference to FIG. 6. Elements labelled with the same reference numerals as the nitrogen production apparatuses 100 to 102 of Embodiment 1 and the nitrogen production apparatus 103 of Embodiment 2 have the same function, and will not be described again As shown in FIG. 6, a subcooler 71 may be arranged on the liquid nitrogen product removal line 37. The liquid nitrogen product is further cooled by the subcooler 71. A portion of the liquid nitrogen product may be diverted after the subcooler 71 and expanded and cooled by a subcooler expansion valve 72 for use as a coolant for the subcooler 71. The first low-temperature air fed from the first turbine 2 may also be introduced into the subcooler 71 as a coolant.

The liquid nitrogen product passed through the subcooler 71 may be discharged after introducing into the main heat exchanger 1 to recover cold.

Example 1

The nitrogen production apparatus 100 according to Embodiment 1 (shown in FIG. 2) was used for a demonstration simulating the pressure (barA), temperature (° C.), flow rate (kg/h), and the like in each unit when air having 75.6 wt % nitrogen, a temperature of 40° C., and a pressure of 22.2 barA was used as feed air at a flow rate of 1547 $Nm^3/h$.

Results

The pressure of the feed air received from outside by the feed air compressor 61 was boosted from 1.013 barA to 22.7 barA.

Subsequently, the feed air scrubbed of carbon dioxide gas and moisture in the scrubbing section was diverted, and 1100 $Nm^3/h$ comprising a portion thereof was introduced into the main heat exchanger 1. The temperature of the feed air when introduced into the main heat exchanger 1 was 40° C.

The feed air not introduced into the main heat exchanger 1 (447 $Nm^3/h$) was diverted by the second branch line 23 and introduced into the second turbine 3. The feed air at a temperature of 40° C. was expanded and cooled by the second turbine 3 to produce a second low-temperature air having a temperature reduced to −92° C. The second low-temperature air was introduced into the main heat exchanger 1, exchanged heat with the feed air, then was discharged.

The feed air introduced into the main heat exchanger 1 without passing through the second turbine 3 was precooled inside the main heat exchanger 1 to produce precooled feed air. The precooled feed air was diverted to introduce a portion of the precooled feed air (200 $Nm^3/h$) into the first turbine 2. The precooled feed air at a temperature of −115° C. was expanded and cooled by the first turbine 2 to produce a first low-temperature air having a temperature reduced to −184° C. The first low-temperature air was introduced into the cold side of the main heat exchanger 1, released cold by exchanging heat with the feed air and the precooled feed air, then was discharged.

The precooled feed air not passed through the first turbine 2 was cooled by exchanging heat with the first low-temperature air to produce a low-temperature feed air having a temperature of −152° C.

The low-temperature feed air was expanded and cooled to −166° C. by the feed air expansion valve 4. The low-temperature feed air and the feed liquid nitrogen were introduced into the distillation column 5 and rectified. The distillation column had an operating pressure of 9.9 barA.

The oxygen-rich liquid pooled in a bottom section of the distillation column 5 was introduced into the condensing section at a temperature of −172° C., and exchanged heat in the condensing section 9 to produce a waste gas (recycled air). A portion (700 $Nm^3/h$) of the waste gas (total flow rate: 1140 $Nm^3/h$) was compressed by the recycled air compressor 12 and reintroduced into the distillation column 5. The waste gas not introduced into the recycled air compressor 12 (440 $Nm^3/h$) was expanded, cooled, and introduced into the main heat exchanger 1.

Such a configuration could obtain liquid nitrogen (460 $Nm^3/h$) having a temperature of −170° C. and a pressure of 9.8 barA. The energy required to produce liquid nitrogen was 0.6 $kWh/Nm^3$, and liquid nitrogen could be produced with little energy because no liquefier was required.

Example 2

The nitrogen production apparatus 103 according to Embodiment 2 (shown in FIG. 5) was used for a demonstration simulating the pressure (barA), temperature (° C.), flow rate (kg/h), and the like in each unit when air having 75.6 wt % nitrogen, a temperature of 40° C., and a pressure of 14.0 barA was used as feed air at a flow rate of 1547 $Nm^3/h$.

Results

The pressure of the feed air received from outside by the feed air compressor 61 was boosted from 1.013 barA to 14.5 barA.

Subsequently, the feed air scrubbed of carbon dioxide gas and moisture in the scrubbing section was boosted to 15.0 barA by the first compressor 14. The feed air cooled to 40° C. by the first cooler 16 was then diverted, and 1100 $Nm^3/h$ comprising a portion thereof was introduced into the second compressor 15. The feed air boosted to 22.6 barA by the second compressor 15, then cooled to 40° C. by the second cooler 17 was introduced into the main heat exchanger 1.

The feed air not introduced into the second compressor 15 (447 $Nm^3/h$) was diverted by the second branch line 23 and introduced into the second turbine 3. The feed air at a temperature of 40° C. was expanded and cooled by the second turbine 3 to produce a second low-temperature air having a temperature reduced to −92° C. The second low-temperature air was introduced into the main heat exchanger 1, exchanged heat with the feed air, then was discharged.

The feed air introduced into the main heat exchanger 1 without passing through the second turbine 3 was precooled inside the main heat exchanger 1 to produce precooled feed air. The precooled feed air was diverted to introduce a portion of the precooled feed air (200 $Nm^3/h$) into the first turbine 2. The precooled feed air at a temperature of −115° C. was expanded and cooled by the first turbine 2 to produce a first low-temperature air having a temperature reduced to −184° C. The first low-temperature air was introduced into the cold side of the main heat exchanger 1, released cold by exchanging heat with the feed air and the precooled feed air, then was discharged.

The precooled feed air not passed through the first turbine 2 was cooled by exchanging heat with the first low-temperature air to produce a low-temperature feed air having a temperature of −152° C.

The low-temperature feed air was expanded and cooled to −166° C. by the feed air expansion valve 4. The low-temperature feed air and the feed liquid nitrogen was introduced into the distillation column 5 and rectified. The distillation column had an operating pressure of 9.9 barA.

The oxygen-rich liquid pooled in a bottom section of the distillation column was introduced into the first condenser 7 of the condensing section at a temperature of −172° C., and exchanged heat in the first condenser 7 to produce a waste gas (recycled air). The first condenser 7 had an evaporation pressure of 6.3 barA, and the oxygen-rich liquid in the first condenser 7 was evaporated to produce a 700 $Nm^3/h$ waste gas (recycled air). The recycled air was compressed to 10.0 barA by the recycled air compressor 12, then cooled to −153° C. by the main heat exchanger 1 and introduced into the distillation column 5.

The oxygen-rich liquid not vaporized in the first condenser 7 was introduced into the second condenser 6. The second condenser 6 had an evaporation pressure of 5.0 barA. The oxygen-rich liquid vaporized by heat exchange in the second condenser 6 was introduced into the main heat exchanger 1 as waste gas and released cold, then was expanded and cooled to use the cold more, and was introduced into the main heat exchanger 1.

Such a configuration could obtain liquid nitrogen (460 $Nm^3/h$) having a temperature of −170° C. and a pressure of 9.8 barA. The energy required to produce liquid nitrogen was 0.5 $kWh/Nm^3$. With the present embodiment, by connecting a shaft end of the first compressor 14 to a shaft end of the first turbine 2, a shaft end of the first cooler 16 to a shaft end of the second turbine 3, and a shaft end of the recycled air compressor 12 to the third turbine 13, the power collected by expansion was used for compression. As a result, it could be said that liquid nitrogen could be produced with even less energy.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

LIST OF REFERENCE NUMERALS

1. Main heat exchanger
2. First turbine
3. Second turbine
4. Feed air expansion valve
5. Distillation column
6. Second condenser
7. First condenser
9. Condensing section
12. Recycled air compressor
13. Third turbine
14. First compressor
15. Second compressor
16. First cooler
17. Second cooler
18. First distilling section
19. Second distilling section
23. Second branch line
24. Second low-temperature air introduction line
25. First branch line
26. First low-temperature air introduction line
28. Main feed air supply line
31. Oxygen-rich liquid introduction line
34. Recycled air removal line
36. Recycled air introduction line

37. Liquid nitrogen product removal line

42. Compressed recycled air cooling line

43. Waste gas line

61. Feed air compressor

62. Scrubbing section

100. Nitrogen production apparatus

What is claimed is:

1. A method for producing a liquid nitrogen product, the method comprising:

a precooling step for cooling at least a portion of feed air scrubbed of specified impurities to a first temperature and cooling the precooled feed air;

a cooling step for cooling at least a first portion of the feed air cooled by the cooling step to a second temperature lower than the first temperature to produce a low-temperature feed air;

a first expanding step for expanding and cooling a second portion of the feed air cooled by the precooling step to produce a first low-temperature air;

a second expanding step for expanding and cooling at least a third portion of the feed air to produce a second low-temperature air;

a first introducing step for expanding and introducing the feed air cooled by the cooling step into a lower section than a first distilling section in a distillation column having the first distilling section;

a condensing step for condensing at least a portion of the gas inside the distillation column by exchanging heat with an oxygen-rich liquid pooled in a lower section of the distillation column by a condensing section arranged in an upper section of the distillation column;

a recycled air compressing step for diverting waste gas removed from the condensing section arranged in the upper section of the distillation column and compressing the diverted waste gas in a recycle air compressor;

a waste gas heat exchange step for exchanging heat between the not diverted waste gas and either the feed air or the precooled feed air;

a second introducing step for introducing the compressed recycled air compressed by the recycled air compressing step into the lower section of the distillation column than the location of the first distilling section; and a liquid nitrogen product removing step for removing a liquid nitrogen product from the distillation column, wherein the feed air exchanges heat with the first low-temperature air and/or the second low-temperature air in the precooling step and the cooling step, wherein the diverted waste gas is sent from the condensing section to the recycled air compressor for the recycled air compressing step without being warmed via heat exchange against the feed air.

2. A nitrogen production apparatus comprising:

a main heat exchanger configured to cool a feed air scrubbed of specified impurities;

a feed air expansion valve configured to expand a low-temperature feed air obtained by cooling feed air in the main heat exchanger to produce a portion of the low-temperature feed air as liquefied feed air; and a distillation column having a first distilling section whereto the expanded low-temperature feed air is introduced;

a main feed air supply line configured to supply the feed air through the main heat exchanger to the distillation column;

a first branch line branching from the main feed air supply line inside the main heat exchanger;

a first turbine configured to expand a first diverted feed air supplied by the first branch line to produce a first low-temperature air;

a first low-temperature air introduction line configured to introduce the first low-temperature air to the main heat exchanger;

a second branch line branching from the main feed air supply line in front of the main heat exchanger;

a second turbine for expanding a second diverted feed air supplied by the second branch line to produce a second low-temperature air having a lower temperature than the first low-temperature air;

a second low-temperature air introduction line configured to introduce the second low-temperature air into the main heat exchanger;

a condensing section arranged in an upper section of the distillation column;

an oxygen-rich liquid introduction line configured to feed at least a portion of oxygen-rich liquid from a lower section of the distillation column and introducing the oxygen-rich liquid into the condensing section as a coolant;

a recycled air removal line configured to remove a first portion of waste gas (recycled air) from a location in the condensing section;

a recycled air compressor configured to compress the first portion of the waste gas supplied by the recycled air removal line;

a recycled air introduction line configured to introduce the compressed recycled air fed by the recycled air compressor to the distillation column at a lower section of the distillation column than the location of the first distilling section;

a waste gas line configured to remove a second portion of the waste gas from the condensing section to introduce into the main heat exchanger; and a liquid nitrogen product removal line configured to remove liquid nitrogen from the distillation column, wherein the recycled air compressor is configured to receive the first portion of waste gas from the condensing section without the first portion of waste gas being warmed via heat exchange against the feed air in the main heat exchanger.

3. The nitrogen production apparatus as claimed in claim 2, wherein the condensing section further comprises a second condenser and a first condenser;

wherein the recycled air removal line is arranged in the condensing section so as to introduce at least a portion of gas that was evaporated by the first condenser into the recycled air compressor; and the waste gas line is arranged so as to introduce at least a portion of gas that was evaporated by the second condenser into the main heat exchanger.

4. The nitrogen production apparatus as claimed in claim 3, wherein an oxygen-rich liquid is supplied to the first condenser through the oxygen-rich liquid introduction line before supplying to the second condenser.

5. The nitrogen production apparatus as claimed in claim 2, further comprising:

a third turbine that is configured to expand the waste gas supplied by the waste gas line through the main heat exchanger to produce a low-temperature waste gas; and a shaft end of the third turbine is connected to a shaft end of the recycled air compressor.

6. The nitrogen production apparatus as claimed in claim 2, further comprising a compressed recycled air cooling line configured to cool the compressed recycled air by the main heat exchanger.

7. The nitrogen production apparatus as claimed in claim 2, wherein:

the distillation column comprises a second distilling section arranged below the first distilling section;

the low-temperature feed air is introduced into a section that is lower than the location of the first distilling section and higher than the location of the second distilling section; and the compressed recycled air is introduced into a section that is lower than the location of the second distilling section.

8. The nitrogen production apparatus as claimed in claim 2, further comprising:

a first compressor for further compressing the feed air;

a first cooler for cooling the feed air fed from the first compressor;

a second compressor for further compressing the feed air fed from the first cooler;

a second cooler for cooling the feed air fed from the second compressor;

a shaft end of the second turbine is connected to a shaft end of the first compressor and/or the second compressor; and a shaft end of the first turbine is connected to a shaft end of the first compressor and/or the second compressor.

9. The nitrogen production apparatus as claimed in claim 2, further comprising a feed air compressor configured to compress air; and a scrubbing section for scrubbing specified impurities from the air compressed by the feed air compressor to produce the feed air.

* * * * *